US009073072B2

(12) United States Patent
Mattson et al.

(10) Patent No.: US 9,073,072 B2
(45) Date of Patent: Jul. 7, 2015

(54) PAINT SPRAYER WITH HOSE REEL

(75) Inventors: Barry W. Mattson, Elk River, MN (US); Bradley H. Hines, Andover, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 180 days.

(21) Appl. No.: 13/141,476

(22) PCT Filed: Dec. 28, 2009

(86) PCT No.: PCT/US2009/069598

§ 371 (c)(1), (2), (4) Date: Jun. 22, 2011

(87) PCT Pub. No.: WO2010/078261

PCT Pub. Date: Jul. 8, 2010

(65) Prior Publication Data

US 2011/0253229 A1 Oct. 20, 2011

Related U.S. Application Data

(60) Provisional application No. 61/141,479, filed on Dec. 30, 2008.

(51) Int. Cl.

| | |
|---|---|
| ***B65H 75/42*** | (2006.01) |
| ***B65H 75/20*** | (2006.01) |
| ***B05B 7/24*** | (2006.01) |
| ***B05B 7/00*** | ***B05B 9/04*** |
| (2006.01) | ***B65H 75/44*** |
| (2006.01) | *B65H 75/40* |
| (2006.01) | (2006.01) |

(52) U.S. Cl.

CPC ..... *B05B 7/2491* (2013.01); *B65H 75/20* (2013.01); *B65H 75/403* (2013.01); *B05B 7/0093* (2013.01); *B05B 9/0403* (2013.01); *B65H 75/42* (2013.01); *B65H 75/4431* (2013.01); *B65H 2701/33* (2013.01); *B65H 2701/537* (2013.01)

(58) Field of Classification Search

USPC ..... 137/355.26–355.28, 355.16–355.28, 137/355.12; 239/DIG. 14, 198; 242/376, 242/407, 407.1, 604.1, 400, 401, 403, 242/403.1, 597

See application file for complete search history.

(56) References Cited

U.S. PATENT DOCUMENTS 1,451,745 A * 4/1923 Sommer ..... 242/608.8
3,290,453 A * 12/1966 Jensen ..... 191/12.4

(Continued)

FOREIGN PATENT DOCUMENTS

FR 2828482 * 2/2003
GB 2452758 A * 3/2009

OTHER PUBLICATIONS

Competitor Titan Tools REEL EZ product has similar design—NPL attached p. 21 of their Airless Spray Accessories brochure for pictures of this product. Full brochure available at http://www.titantool.com/portal/us_titan_brochures_en_titantool,230697,230635.html.

*Primary Examiner* — Craig Schneider
*Assistant Examiner* — Jonathan Waddy
(74) *Attorney, Agent, or Firm* — Kinney & Lange, P.A.

(57) ABSTRACT

The main upright (14) on a paint sprayer (10) frame (12) is provided with a hose guide (16) and a swivel (18). Attached to the swivel (18) is a generally rectangular hose reel (20) having a retractable handle (22) and a releasable rotation lock (24). Reel (20) is formed from a generally rectangular (mirroring the sprayer frame) loop (20*a*) having secondary loops (20*b*) attached thereto. A swivel plate (20*c*) bisects loop (20*a*). The upper end of loop (20*a*) may be used as a handle for the sprayer (10).

4 Claims, 9 Drawing Sheets

(56) References Cited

U.S. PATENT DOCUMENTS

| | | | | |
|---|---|---|---|---|
| 5,622,319 | A * | 4/1997 | Babb et al. | 239/722 |
| 5,655,728 | A * | 8/1997 | Yang | 242/395.1 |
| 5,732,733 | A * | 3/1998 | Negus et al. | 137/355.27 |
| 6,276,631 | B1 * | 8/2001 | Mio et al. | 242/604.1 |
| 6,834,670 | B2 * | 12/2004 | Rosine et al. | 137/355.27 |
| 7,073,529 | B1 * | 7/2006 | Harkey | 137/355.23 |
| D562,671 | S * | 2/2008 | Dethier | D8/359 |
| 2004/0099760 | A1 * | 5/2004 | Laporta | 242/395 |
| 2005/0247345 | A1 | 11/2005 | Nagler et al. | |

* cited by examiner

PAINT SPRAYER WITH HOSE REEL

This application claims the benefit of U.S. application Ser. No. 61/141,479, filed Dec. 30, 2008, the contents of which are hereby incorporated by reference.

BACKGROUND ART

1. Technical Field

Airless and other paint sprayers are well known and often have a loop on the handle for hanging hose.

2. Disclosure of the Invention

While such loops are effective, it is an object of this invention to provide a method of hose winding and organization which the user will find easy and effective. Towards that end, the main upright on the sprayer frame is provided with a hose guide and a swivel. Attached to the swivel is a generally rectangular hose reel having a retractable handle and a releasable rotation lock.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
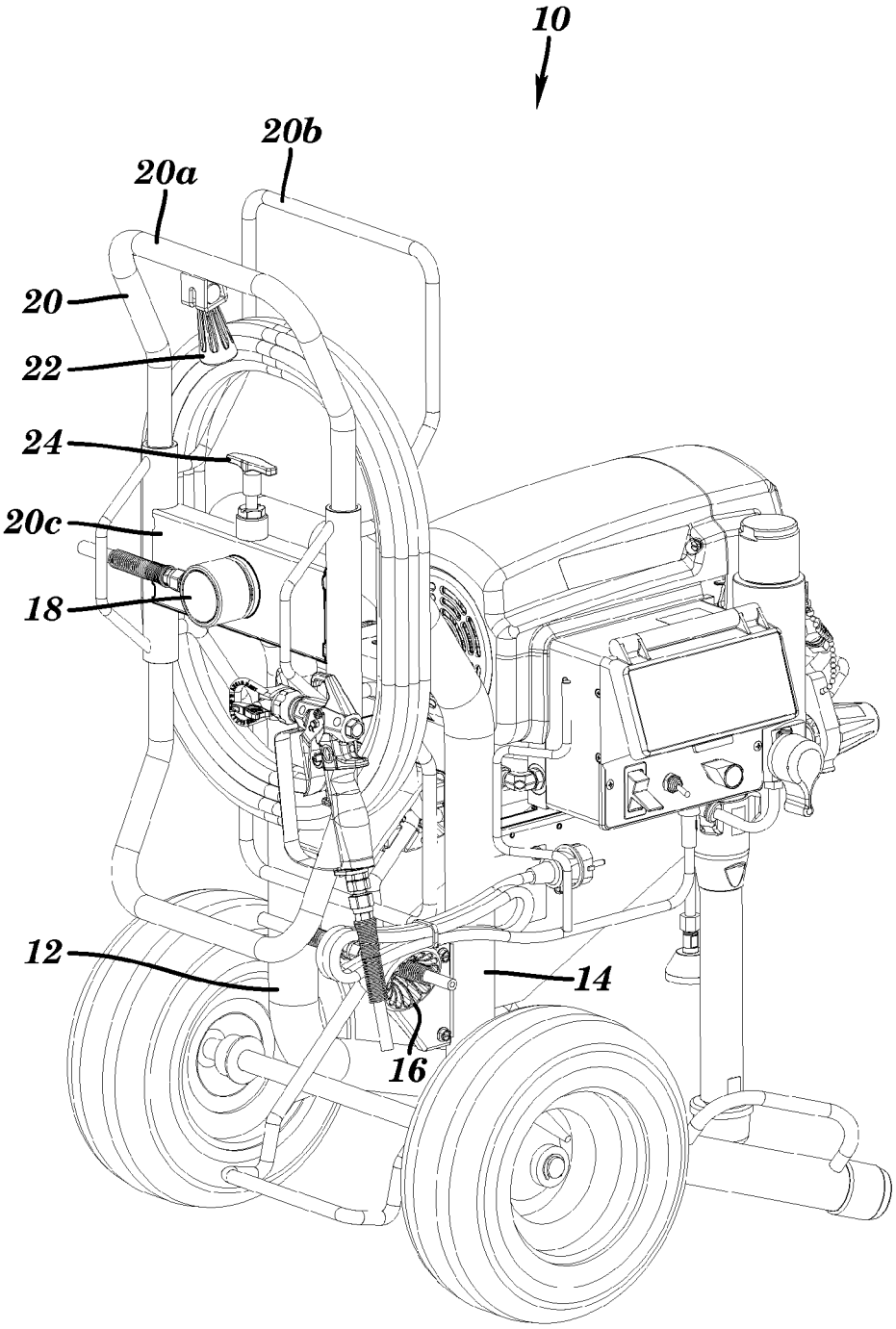
FIG. 1 shows a side view of a paint sprayer having a hose reel according to the instant invention.
Figure 2:
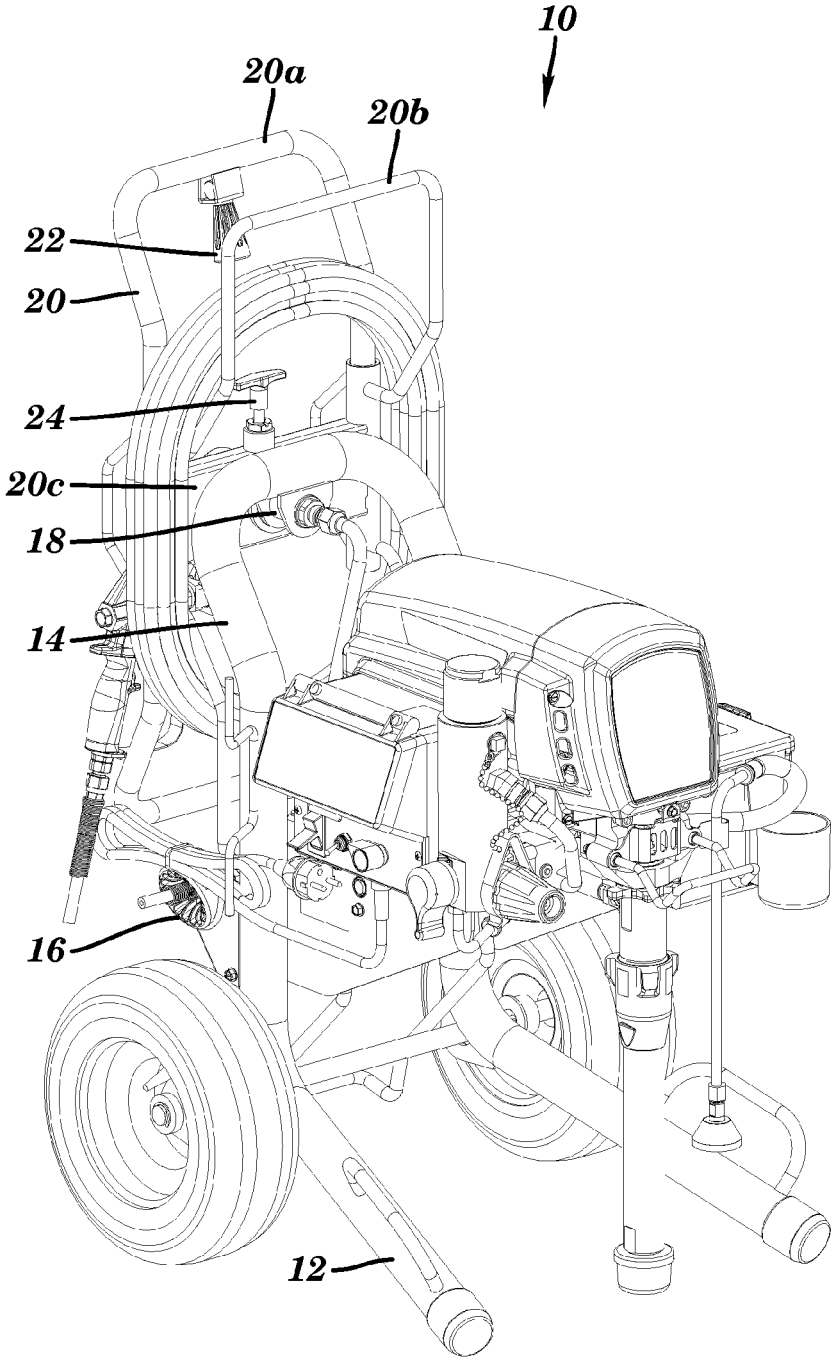
FIG. 2 shows a front view of a paint sprayer having a hose reel according to the instant invention.
Figure 3:
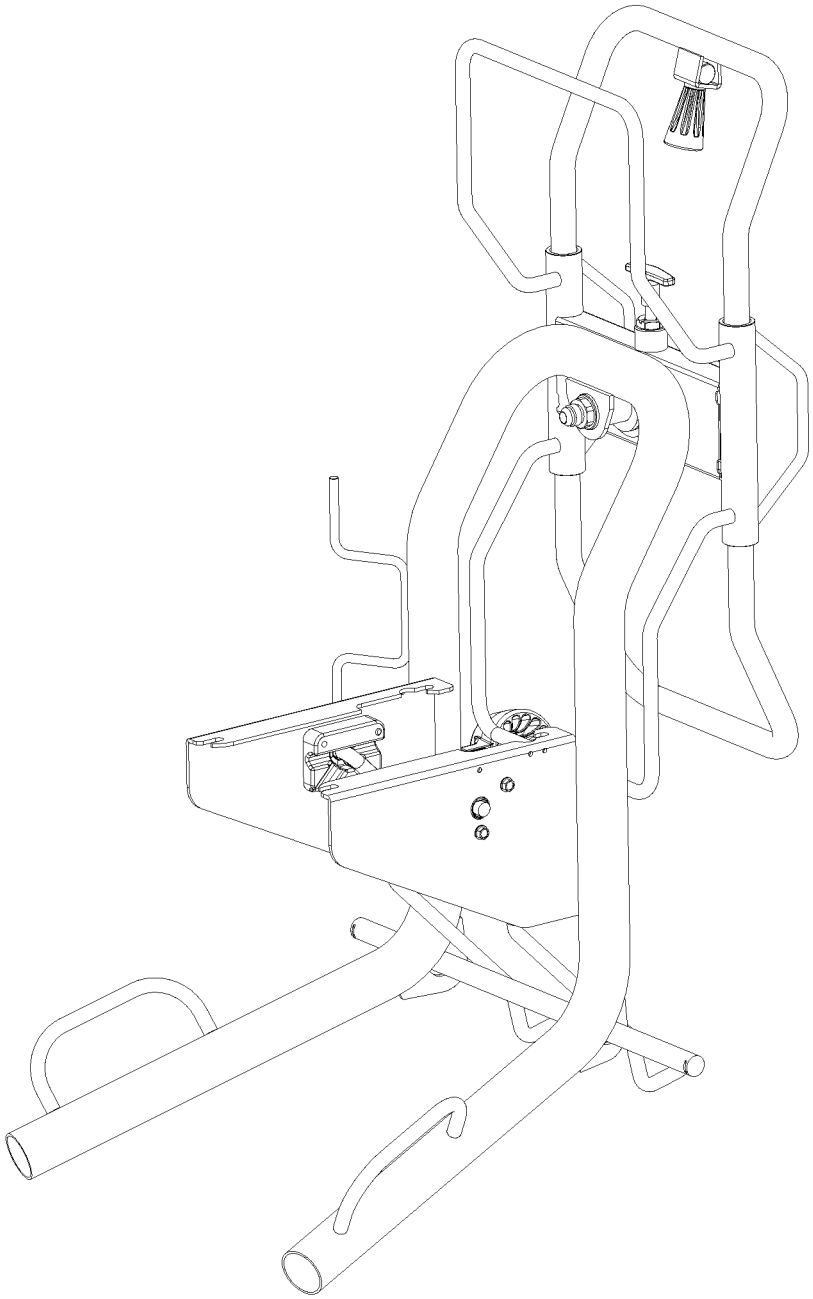
FIG. 3 shows a paint sprayer frame having a hose reel according to the instant invention.
Figure 4:
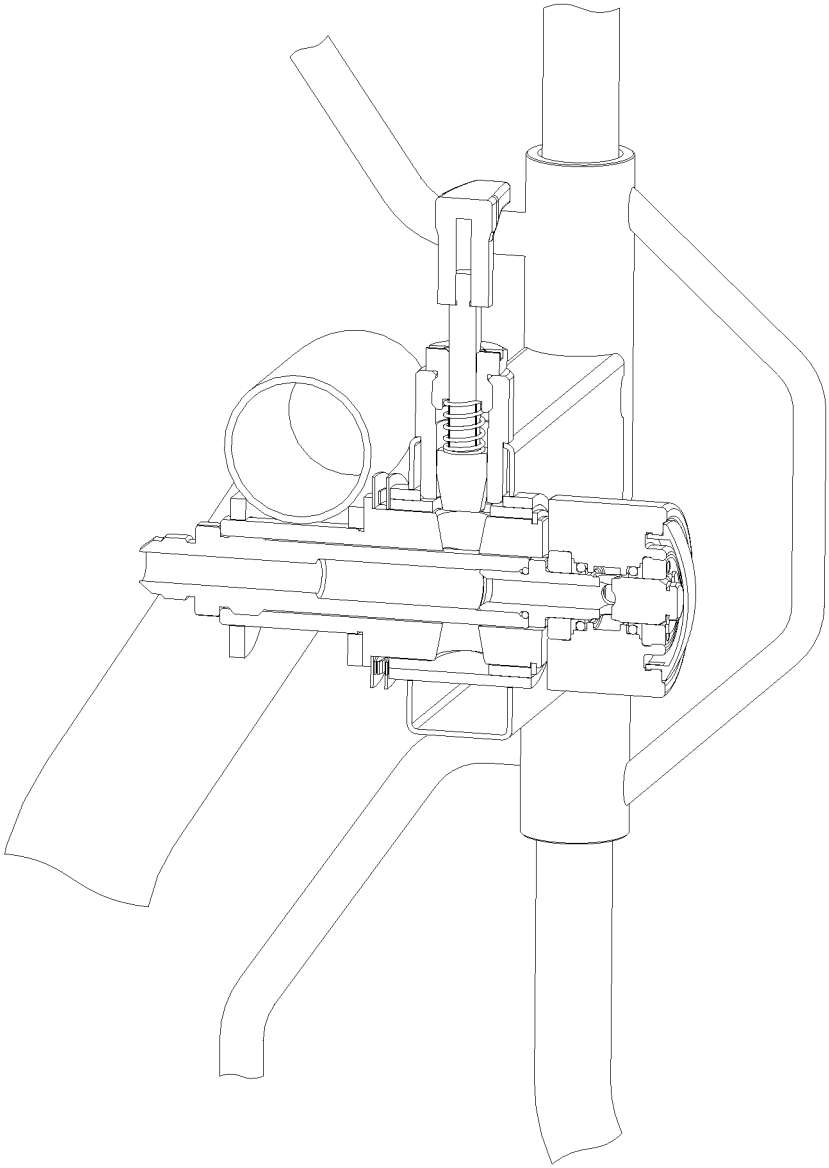
FIG. 4 shows a detail view of the swivel and lock mechanism according to the instant invention.
Figure 5:
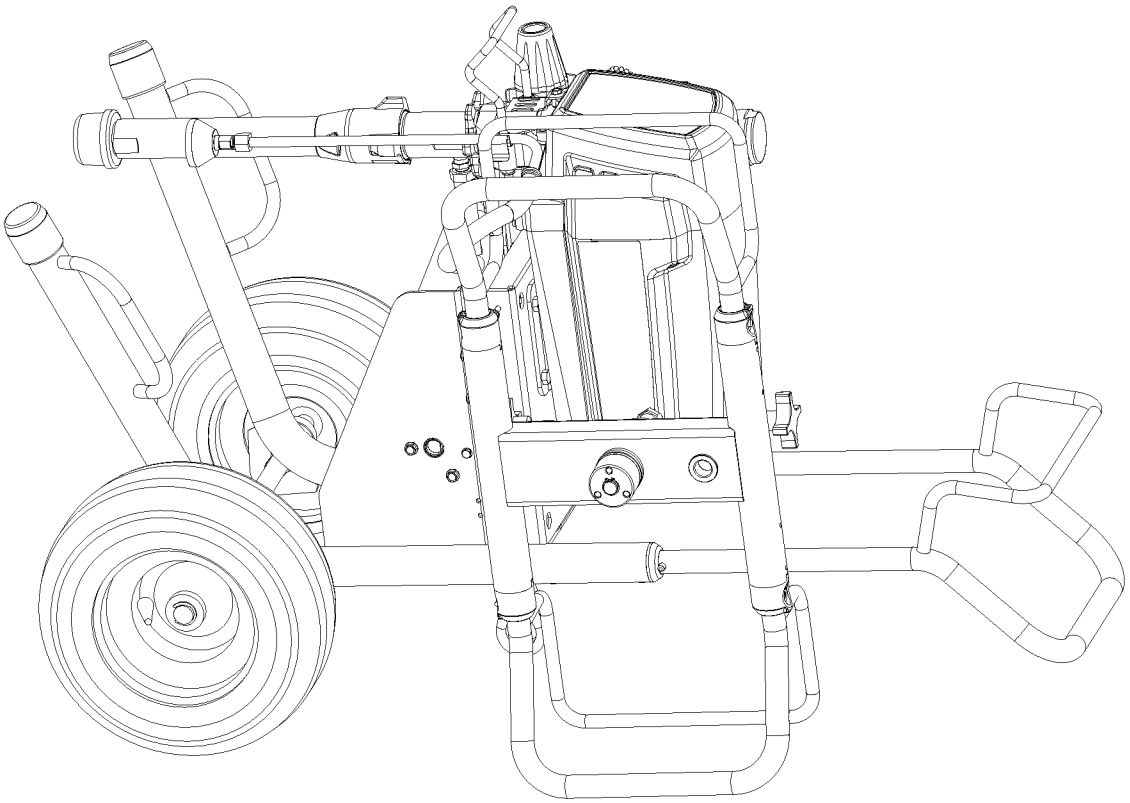
FIG. 5 shows an alternate embodiment of a paint sprayer having a hose reel according to the instant invention.
Figure 6:
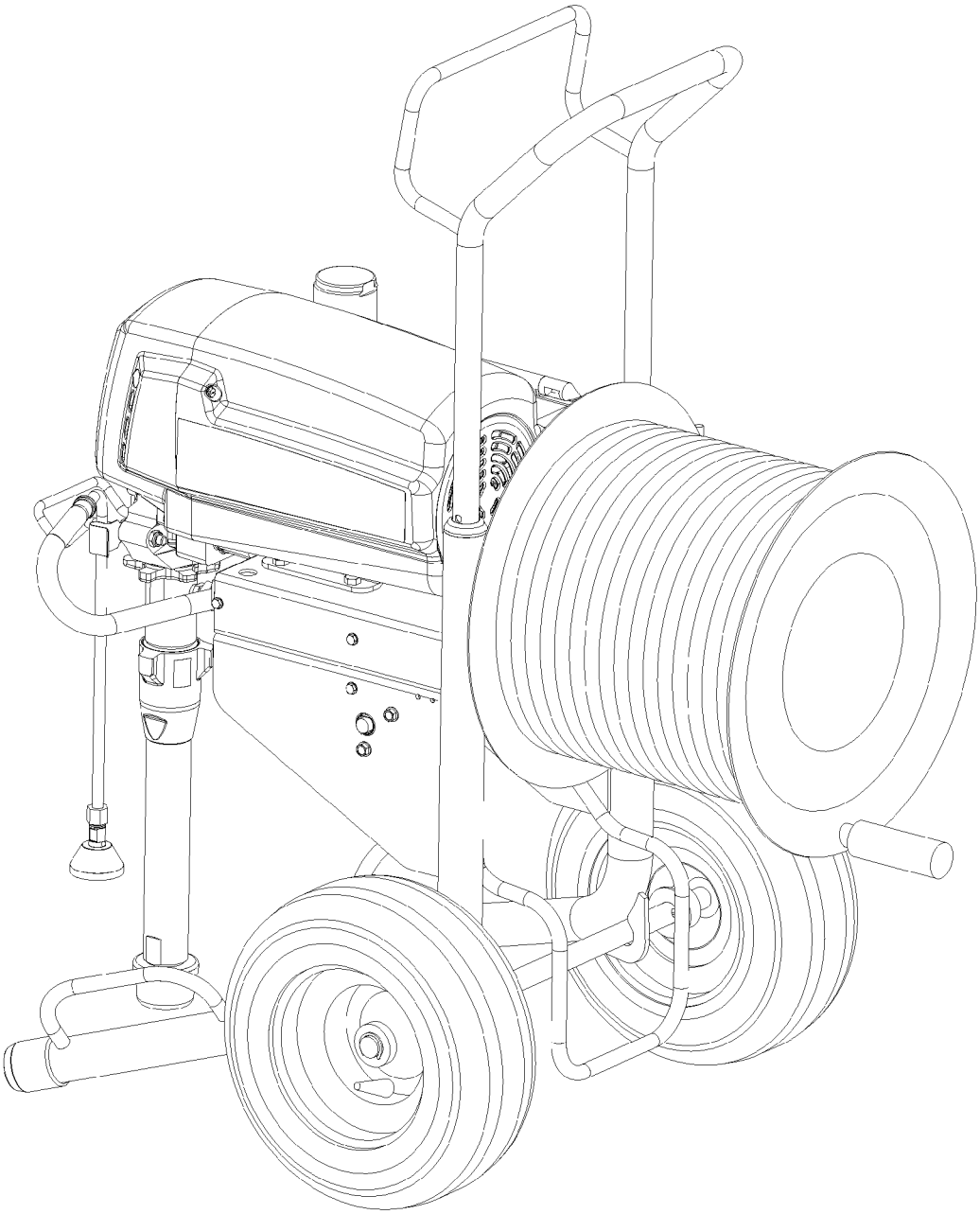
FIG. 6 shows another alternate embodiment of a paint sprayer having a hose reel according to the instant invention.
Figure 7:
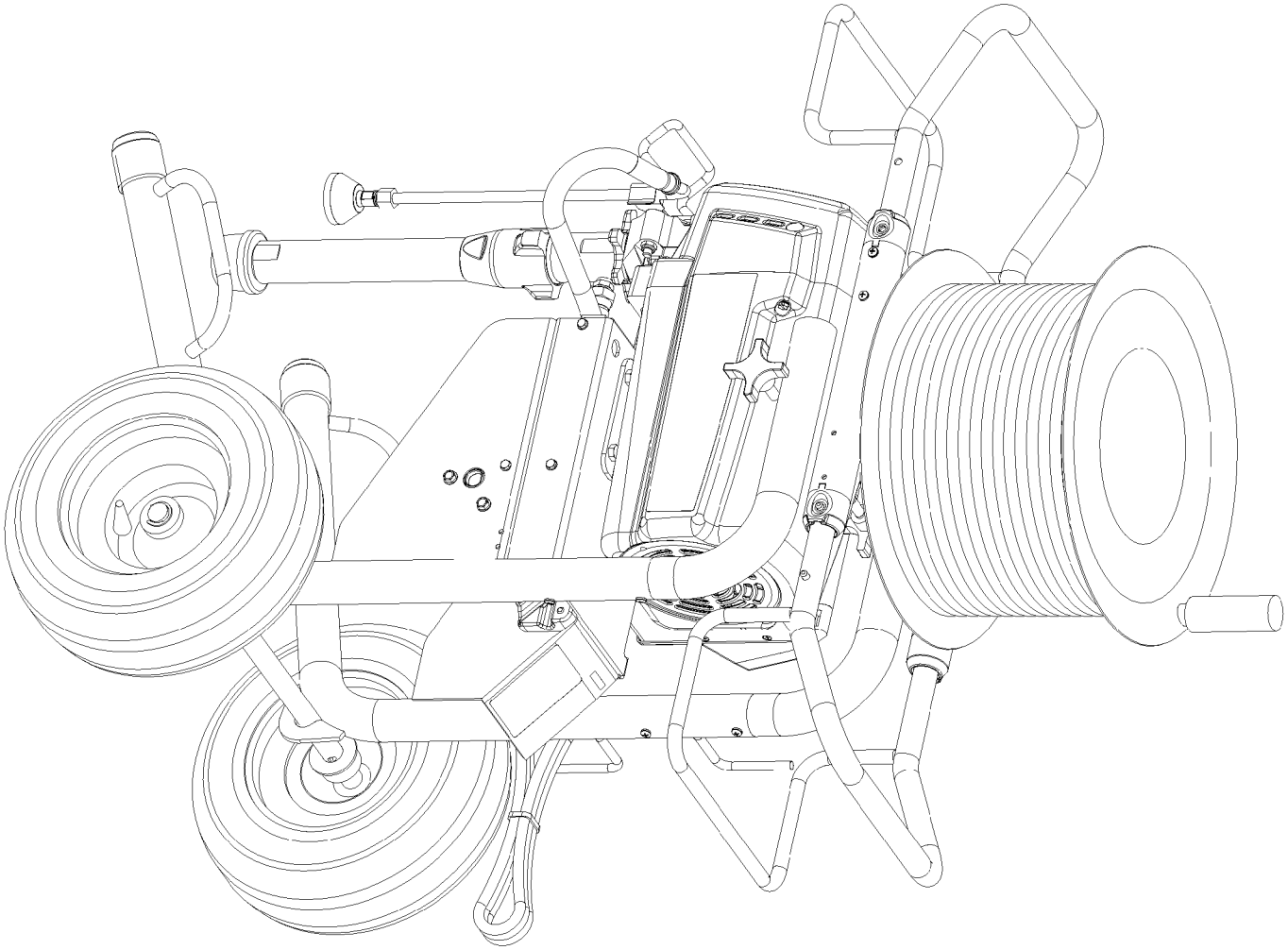
FIG. 7 shows another alternate embodiment of a paint sprayer having a hose reel according to the instant invention.
Figure 8:
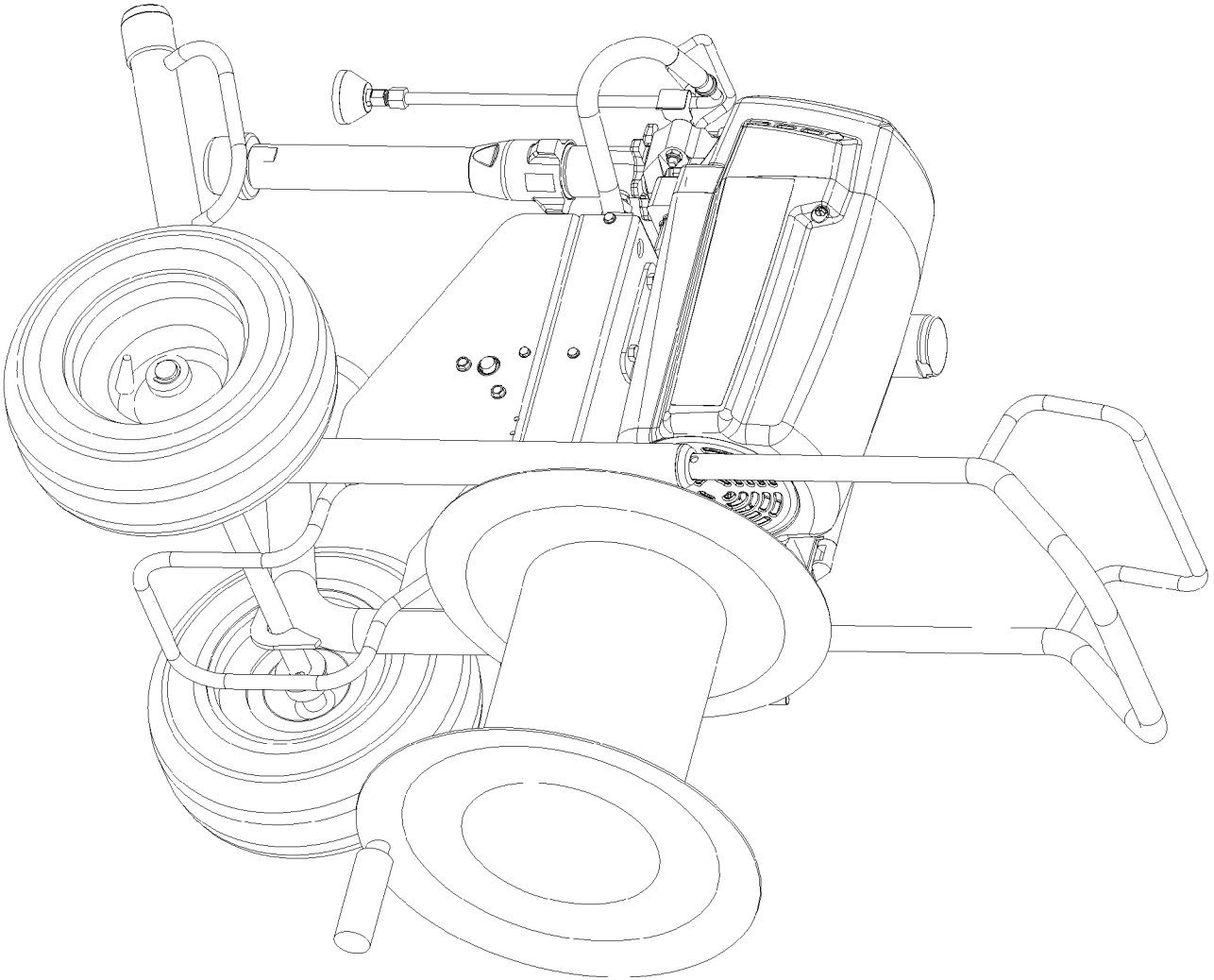
FIG. 8 shows another alternate embodiment of a paint sprayer having a hose reel according to the instant invention.
Figure 9:
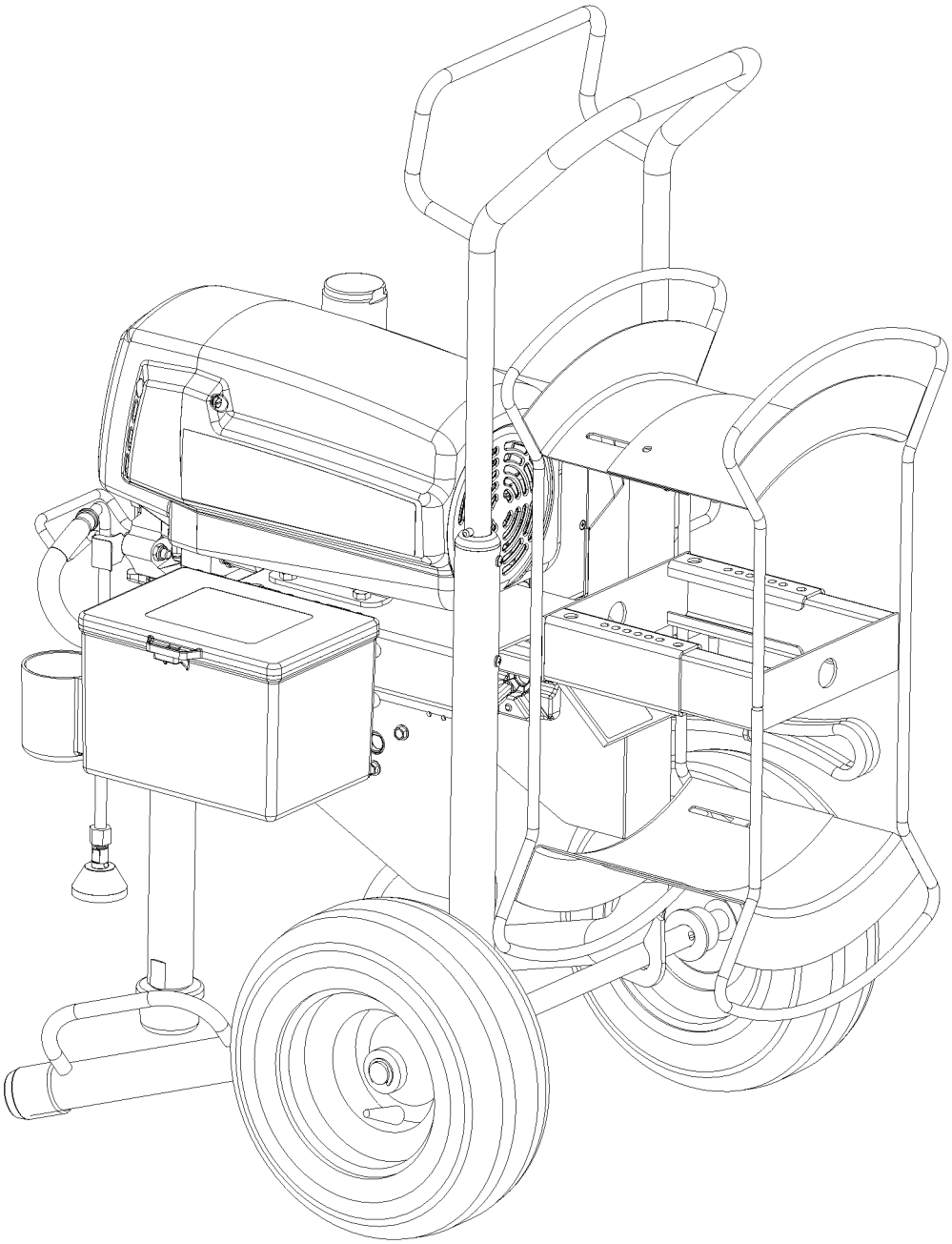
FIG. 9 shows another alternate embodiment of a paint sprayer having a hose reel according to the instant invention.

Towards that end, the main upright 14 on the sprayer 10 frame 12 is provided with a hose guide 16 and a swivel 18. Attached to the swivel 18 is a generally rectangular hose reel 20 having a retractable handle 22 and a releasable rotation lock 24. Reel 20 is formed from a generally rectangular (mirroring the sprayer frame) loop 20*a* having secondary loops 20*b* attached thereto. A swivel plate 20*c* bisects loop 20*a*. The upper end of loop 20*a* may be used as a handle for the sprayer 10.

It is contemplated that various changes and modifications may be made to the sprayer with hose reel without departing from the spirit and scope of the invention as defined by the following claims.

The invention claimed is:

1. A paint sprayer comprising:

a frame having an upright;

a swivel attached to said upright;

a hose reel rotatably attached to said swivel, the hose reel comprising:

a first rim portion constituted by a primary loop, which is rectangular when looking at the reel in the direction of a swivel axis of the swivel, wherein the primary loop includes a first side member having a first end and a second end, a second side member having a first end and a second end, a swivel plate that extends between the first and second side members and is attached to the swivel, a first U-shaped end portion having a first leg connected to the first end of the first side member and a second leg connected to the first end of the second side member, and a second U-shaped end portion having a first leg connected to the second end of the first side member and a second leg connected to the second end of the second member; and a second rim portion constituted by secondary loops that intersect the primary loop, wherein the secondary loops include a third U-shaped end portion having a first leg connected to the first end of the first side member and a second leg connected to the first end of the second side member, and a fourth U-shaped end portion having a first leg connected to the second end of the first side member and a second leg connected to the second end of the second side member, the first and third U-shaped end portions being spaced apart to define a first hose receiving area through which a hose can be wound, and the second and fourth U-shaped end portions being spaced apart to define a second hose receiving area through which the hose can be wound.

2. The paint sprayer of claim 1 further comprising a retractable handle on the primary loop of the hose reel.

3. The paint sprayer of claim 1 further comprising a releasable rotation lock.

4. The paint sprayer of claim 1 wherein said hose reel is generally rectangular and conforming to a shape of said frame.

* * * * *